United States Patent [19]

Menk et al.

[11] Patent Number: 4,900,509

[45] Date of Patent: Feb. 13, 1990

[54] PROCESS FOR MANUFACTURING CAST IRON CONTAINING VERMICULAR GRAPHITE

[75] Inventors: Werner Menk, Schaffhausen; Urs Brandenberger, Dachsen, both of Switzerland

[73] Assignee: Georg Fischer Aktiengesellschaft, Schaffhausen, Switzerland

[21] Appl. No.: 723,041

[22] Filed: Apr. 15, 1985

[30] Foreign Application Priority Data

Apr. 13, 1984 [CH] Switzerland ..... 1868/84

[51] Int. Cl.[4] ..... C22C 33/08

[52] U.S. Cl. ..... 420/31; 420/18

[58] Field of Search ..... 75/130 R, 53, 130 A

[56] References Cited

U.S. PATENT DOCUMENTS 3,764,305 10/1973 Andersson ..... 75/96
4,227,924 10/1980 Subramanian ..... 75/130 R
4,246,026 1/1981 Stefanescu ..... 75/130 R
4,261,740 4/1981 Plessers ..... 75/130 R
4,544,407 10/1985 Linkert ..... 75/53

*Primary Examiner*—Peter D. Rosenberg
*Attorney, Agent, or Firm*—Marmorek, Guttman & Rubenstein

[57] ABSTRACT

A process for the manufacture of cast iron containing vermicular graphite is described, in which nodular cast iron (GGG) is used as a starting melt. The GGG melt can be produced in a converter in a precise and reproducible way, whereby the sulphur and oxygen contents of the GGG melt are limited within narrow ranges. Additional sulphur is added to the GGG melt in an amount determined by an empirical formula depending on the magnesium and sulphur contents of the GGG melt to produce cast iron containing vermicular graphite (GGV). The GGV is produced by the present process with precision and in a reproducible manner.

10 Claims, No Drawings

PROCESS FOR MANUFACTURING CAST IRON CONTAINING VERMICULAR GRAPHITE

BACKGROUND OF THE INVENTION.

This invention relates to a process and a means for manufacturing cast iron containing vermicular graphite.

Cast iron containing vermicular graphite (referred to herein as "GGV") is used as a construction material frequently between cast iron containing lamelle graphite (GGL) and cast iron containing nodular graphite (GGG). This construction material is superior to the GGL material in view of its special mechanical qualities, such as it high tensile strength, sturdiness and elasticity module. In comparison to the GGG construction material, cast iron containing vermicular graphite possesses higher heat conductivity and better casting ability.

The demand for the GGV construction material has risen dramatically during the last years. However, it has been difficult to master a precise, reproducible process for manufacturing GGV in order to keep pace with rising demand. Because of this, many plants were forced to abstain from the manufacture of GGV.

In DE-OS No. 24 58 033 and its corresponding U.S. Pat. No. 3,666,449, which are incorporated herein by reference, a process is described in which a starting melt is pre-treated with magnesium until the sulphur content falls below 0.01% by weight of S, and in which the time for adding rare earth metals to the melt is coordinated with the Mg treatment so that nodular graphite is not produced.

In DE-OS No. 24 58 033 a process is also described in which the starting melt is treated with Mg prior to adding rare earth metals, such as a cerium alloy. In this process as well, the amount of Mg which is added is controlled in such a way that no more than 0.01% by weight of S remains and so that nodular graphite is not produced.

It is the task of the present invention to improve the known iron making processes in a way so that cast iron with vermicular graphite can be produced in a rapid, precise and reproducible manner.

SUMMARY OF THE INVENTION.

This task is accomplished by means of the present invention which comprises a process for producing cast iron containing vermicular graphite wherein a sulphur-containing substance is added to a GGG Melt in accordance with the formula:

$$S=A\times Mg-B$$

wherein S represents the amount of sulphur to be added to the GGG melt in weight percent, Mg represents the amount of magnesium in the GGG melt in weight percent, A is a factor which depends on the magnesium content of the GGG melt, and which is in the range of about 0.09 to 1.2, and B is a constant which depends on the sulphur content of the GGG melt and which is in the range of about −0.02 to 0.05. The cast iron containing vermicular graphite produced in accordance with the present invention has a ratio of magnesium to sulphur in the range from about 2:1 to 1:1.

DETAILED DESCRIPTION OF THE INVENTION

The process of the present invention distinguishes itself from the prior art processes especially by the fact that GGV is produced in a two-step process rather than a one-step process. In the first step of the present invention, a starting melt of GGG is produced. The composition of the GGG melt produced in this first step can be accurately controlled by techniques pioneered by applicant. This GGG melt is manufactured through a process involving de-sulphurization, de-oxidation and magnesium alloying. If the GGG melt is manufactured in a converter previously described and developed by applicant, it is possible to limit the sulphur and oxygen content within very narrow ranges. This is highly desirable since the degree to which the final product is reproducible depends, to a certain extent, on the reproducibility of the GGG melt manufactured in the first step of the process. However, the starting GGG melt may be manufactured by other processes as well.

In the second step of the present invention, a sulphur-containing substance is added to the GGG melt in accordance with the following equation:

$$S=A\times Mg-B$$

In this equation, S represents the amount of pure sulphur present in the substance and in weight percent, Mg represents the magnesium content of the GGG starting melt in weight percent, A is a factor which depends on the magnesium content of the GGG starting melt, and B is a constant which depends on the sulphur content of the GGG melt. Preferably, A should be in the range of about 0.9 to 1.2, more preferably, about 1.08, and B should be in the range of about 0.02 to 0.05, most preferably about 0.016. The cast iron containing vermicular graphite produced in accordance with the present invention has a magnesium to sulphur ratio which is in the range of about 2:1 to 1:1.

The sulfur-containing substance which is added to the GGG melt may be in elementary or in combined form for instance as sulfidic ore or as iron sulfide. The sulphur may also be added as several different substances, e.g., in elementary form with one or more sulphur-containing substances. As a result of the introduction of additional amounts of sulphur into the GGG melt, the spherolitic form of the graphite is changed into vermicular graphite and GGV cast iron is produced in a consistent, reproducible and efficient manner.

In addition, other substances may also be added to the GGG melt to impart desirable properties to the GGV melt. For example, metallic substances such as, cerium, cerium alloy, titanium, calcium, aluminum, zirconium, bismuth etc., may be added to the melt. An inoculation agent, such as FeSi75, may also be added to the melt.

EXAMPLES.

The invention will be explained in further detail by reference to the following examples:

Example 1:

As a starting melt, a GGG melt having the following composition was produced:

3.5 Wt. % C
2.5 Wt. % Si
0.15 Wt. % Mn 0.05 Wt. % Cu
0.05 Wt. % P
0.005 Wt. % S
0.06 Wt. % Mg
Balance iron.

To this GGG melt was added 0.2 wt. % FeS and an inoculation substance, preferably FeSi75. There was obtained a final melt having a Mg/S of 1.27. A structural analysis showed that 90% of the graphite portion had a graphite formation III, i.e., vermicular graphite, according to VDG Merkblatt p441 (Verein Deutscher Giessereifachleute Observation Sheet p441 hereinafter "VDG p441"), Aug., 1962. The remaining 10% corresponded to groups V and VI (spherical graphite).

The end melt was used to spray cast pieces with a module 0.3–2.5 cm.

Example 2

To a GGG melt produced according to the known nickel-magnesium process (in which pure Mg is added to the melt) with the following composition:

3.54 Wt. % C
2.27 Wt. % Si
0.12 Wt. % Mn
0.02 Wt. % Cu
0.01 Wt. % P
0.92 Wt. % Ni
0.006 Wt. % S
0.079 Wt. % Mg
Balance iron, there was added sulphur in the form of iron pyrite (40% S) in an amount corresponding to the equation $S=A\times Mg-B$ 0.050 %. The composition was then inoculated with 0.3% FeSi 75. The composition of the pieces depended on the thickness of the wall. Structural analysis of the cast pieces showed that where the wall was 5 mm thick, 50% of the graphite portion was of graphite formation III (vermicular) according to VDG p441. Where the wall was 40mm thick, 80% of graphite was graphite formation III. The remainder was graphite forms V and VI.

Example 3.

To a GGG melt also produced according to the nickel-magnesium process, with the following composition:

3.52 Wt. % C
2.32 Wt. % Si
0.12 Wt. % Mn
0.02 Wt. % Cu
0.71 Wt. % Ni
0.005 Wt. % S
0.052 Wt. % Mg
Balance iron, sulphur in the form of iron sulfate (40% S) was added in an amount corresponding to the equation $S=A\times Mg-B$ 0.020%. The composition was then inoculated with 0.3% FeSi75. The cast bubble sample having wall thicknesses ranging from 15 to 18 mm showed 70% graphite form III. The remainder was V and VI (according to VDG P 441) and was bubble-free. It thus showed a bubble behavior equal to that of the cast iron.

Example 4.

To a GGG melt produced according to applicant's +GF+−conversion process (in which a Mg compound is added to the melt), with the composition:

3.50 Wt. % C
2.03 Wt. % Si
0.10 Wt. % Mn
0.006 Wt. % S
0.055 Wt. % Mg
Balance Fe, there was added sulphur in the form of a composition containing 18% sulphur according to the equation $S=A\times Mg-B$ 0.041%, mixed with 0.3% FeSi75. Depending on the wall thickness, the cast pieces showed 80% (at 6 mm wall thickness) to 95% (at 30 mm wall thickness) of graphite form III according to VDG P441. The remainder was graphite forms V and VI.

Example 5.

To a GGG melt produced according to the +GF+conversion process, with the composition:

3.57 Wt. % C
2.06 Wt. % Si
0.41 Wt. % Mn
0.11 Wt. % Cu
0.05 Wt. % P
0.006 Wt. % S
0.045 Wt. % Mg
Balance Fe there was added sulphur in the form of pyrite (36% S) corresponding to the equation $S=A\times Mg-B$ 0.035%. A filter of ceramic foam had been inserted into the casting system, in front of which filter there was placed a lump of form-inoculating agent. The ceramic filter is described in applicant's co-pending U.S. application Ser. No. 701,135, filed Feb. 13, 1985, now U.S. Pat. No. 4,713,120. The cast pieces, depending on the wall thickness, showed graphite form III ranging from 50% (at 5 mm wall thickness) to 80% (at 40 mm wall thickness) according to VDG P441. The remainder was graphite forms V and VI.

One special advantage of the present process resides in the fact that, as a first step, a GGG melt is produced having a predetermined composition. Thereafter, sulphur is added in an amount which may be simply calculated from the known coefficients of the GGG melt. This results in a precise and reproducible manufacture of cast iron with vermicular graphite. Furthermore, since the amount of iron needed to produce GGG or GGV is the same, the same automated apparatus may be adapted to produce either GGG or GGV depending on whether the sulphur-containing substance is added to the melt.

If needed, while adding the sulphur-containing substances, an inoculation agent, such as those well known to those skilled in the art, may be added. The inoculation agent may, if needed, also first be introduced into the casting flow or even into the mold.

As a means of carrying out the present process, it will be of special advantage to use a casting pan or a transportable boiler. An example of such a transportable boiler is described in U.S. Pat. No. 3,764,305, which is incorporated herein by reference. Other similar devices are well known to those skilled in the art.

While the invention has been described by reference to specific examples, this was for purposes of illustration only and should not be construed to limit the spirit or scope of the invention.

Having thus described the invention, what we claim as new and desire to be secured by Letters Patent, is as follows:

1. A process for the manufacture of cast iron containing vermicular graphite comprising:

(a) providing a GGG melt; and
(b) adding to said GGG melt a sulphur-containing substance in accordance with the equation:
$S=A\times Mg-B$ wherein
S represents the amount of sulphur in weight percent present in the sulphur containing substance,
Mg represents the amount of magnesium in weight percent present in the GGG melt,
A is a factor which depends on the magnesium content of the GGG melt and which is in the range of 0.9 to 1.2, and
B is a constant which depends on the sulphur content of the GGG melt and which is in the range of about −0.02 to 0.05,
whereby the ratio of magnesium to sulphur in the resulting melt is in the range of from about 2:1 to 1:1, and
wherein A is about 1.08.

2. A process for the manufacture of cast iron containing vermicular graphite comprising:
(a) providing a GGG melt; and
(b) adding to said GGG melt a sulphur-containing substance in accordance with the equation:
$S=A\times Mg-B$ wherein
S represents the amount of sulphur in weight percent present in the sulphur containing substance,
Mg represents the amount of magnesium in weight percent present in the GGG melt,
A is a factor which depends on the magnesium content of the GGG melt and which is in the range of 0.9 to 1.2, and
B is a constant which depends on the sulphur content of the GGG melt and which is in the range of about −0.02 to 0.05,
whereby the ratio of magnesium to sulphur in the resulting melt is in the range of from about 2:1 to 1:1, and
wherein B is in the range of about 0.016 to 0.028.

3. A process for the manufacture of cast iron containing vermicular graphite comprising:
(a) providing a GGG melt; and
(b) adding to said GGG melt a sulphur-containing substance in accordance with the equation:
$S=A\times Mg-B$ wherein
S represents the amount of sulphur in weight percent present in the sulphur containing substance,
Mg represents the amount of magnesium in weight percent present in the GGG melt,
A is a factor which depends on the magnesium content of the GGG melt and which is in the range of 0.9 to 1.2, and
B is a constant which depends on the sulphur content of the GGG melt and which is in the range of about −0.02 to 0.05,
whereby the ratio of magnesium to sulphur in the resulting melt is in the range of from about 2:1 to 1:1, and
wherein the sulphur-containing substance is elemental sulphur.

4. A process for the manufacture of cast iron containing vermicular graphite comprising:
(a) providing a GGG melt; and
(b) adding to said GGG melt a sulphur-containing substance in accordance with the equation:
$S=A\times Mg-B$ wherein
S represents the amount of sulphur in weight percent present in the sulphur containing substance,
Mg represents the amount of magnesium in weight percent present in the GGG melt,
A is a factor which depends on the magnesium content of the GGG melt and which is in the range of 0.9 to 1.2, and
B is a constant which depends on the sulphur content of the GGG melt and which is in the range of about −0.02 to 0.05,
whereby the ratio of magnesium to sulphur in the resulting melt is in the range of from about 2:1 to 1:1, and
wherein the sulphur-containing substance comprises more than one sulphur material, said sulphur material being selected from the group consisting of elemental sulphur and chemically combined sulphur.

5. A process for the manufacture of cast iron containing vermicular graphite comprising:
(a) providing a GGG melt; and
(b) adding to said GGG melt a sulphur-containing substance in accordance with the equation:
$S=A\times Mg-B$ wherein
S represents the amount of sulphur in weight percent present in the sulphur containing substance,
Mg represents the amount of magnesium in weight percent present in the GGG melt,
A is a factor which depends on the magnesium content of the GGG melt and which is in the range of 0.9 to 1.2, and
B is a constant which depends on the sulphur content of the GGG melt and which is in the range of about −0.02 to 0.05,
whereby the ratio of magnesium to sulphur in the resulting melt is in the range of from about 2:1 to 1:1, and
further comprising adding to the GGG melt an inoculation agent.

6. The process of claim 8 wherein the inoculation agent is FeSi75.

7. A process for the manufacture of cast iron containing vermicular graphite comprising:
(a) providing a GGG melt; and
(b) adding to said GGG melt a sulphur-containing substance in accordance with the equation:
$S=A\times Mg-B$ wherein
S represents the amount of sulphur in weight percent present in the sulphur containing substance,
Mg represents the amount of magnesium in weight percent present in the GGG melt,
A is a factor which depends on the magnesium content of the GGG melt and which is in the range of 0.9 to 1.2, and
B is a constant which depends on the sulphur content of the GGG melt and which is in the range of about −0.02 to 0.05,
whereby the ratio of magnesium to sulphur in the resulting melt is in the range of from about 2:1 to 1:1, and
further comprising preventing the reaction products produced by the addition of the sulphur-containing substance from being introduced into the cast piece by means of a filter.

8. The process of claim 11 wherein said filter is a ceramic filter.

9. A process for the manufacture of cast iron containing vermicular graphite comprising:
(a) providing a GGG melt; and (b) adding to said GGG melt a sulphur-containing substance in accordance with the equation:

$S = A \times Mg - B$ wherein

S represents the amount of sulphur in weight percent present in the sulphur containing substance, Mg represents the amount of magnesium in weight percent present in the GGG melt, A is a factor which depends on the magnesium content of the GGG melt and which is in the range of 0.9 to 1.2, and B is a constant which depends on the sulphur content of the GGG melt and which is in the range of about −0.02 to 0.05, whereby the ratio of magnesium to sulphur in the resulting melt is in the range of from about 2:1 to 1:1, and wherein the GGG melt is converted-treated cast iron containing nodular graphite.

10. A process for the manufacture of cast iron containing vermicular graphite comprising:

(a) providing a GGG melt; and (b) adding to said GGG melt a sulphur-containing substance in accordance with the equation:

$S = A \times Mg - B$ wherein

S represents the amount of sulphur in weight percent present in the sulphur containing substance, Mg represents the amount of magnesium in weight percent present in the GGG melt, A is a factor which depends on the magnesium content of the GGG melt and which is in the range of 0.9 to 1.2, and B is a constant which depends on the sulphur content of the GGG melt and which is in the range of about −0.02 to 0.05, whereby the ratio of magnesium to sulphur in the resulting melt is in the range of from about 2:1 to 1:1, and further comprising adding to said GGG melt a metallic substance selected from the group consisting of cerium, cerium alloy, titanium, calcium, aluminum, zirconium and bismuth.

* * * * *